US005701605A

United States Patent [19]

Bowen

[11] Patent Number: 5,701,605

[45] Date of Patent: Dec. 30, 1997

[54] AUTO BIB WITH INTEGRAL TRAY PORTION

[76] Inventor: Gary S. Bowen, 20 Southbury Rd., Cumberland, R.I. 02864

[21] Appl. No.: 410,215

[22] Filed: Mar. 24, 1995

[51] Int. Cl.[6] ..... A41B 13/10; A41D 13/04

[52] U.S. Cl. ..... 2/49.1; 2/46; 2/48; 2/492; 224/270; 224/906

[58] Field of Search ..... 2/46, 48, 49.1, 2/49.2, 49.3, 49.4, 49.5, 50, 51, 52, 104, 105, 106, 113, 114, 115, 75, 80; 224/906, 270, 275

[56] References Cited

U.S. PATENT DOCUMENTS

| | | | |
|---|---|---|---|
| 4,423,523 | 1/1984 | Bodner et al. | 2/48 |
| 4,586,198 | 5/1986 | Alaniz | 2/105 |
| 5,459,877 | 10/1995 | Roberti | 2/46 X |

*Primary Examiner*—Jeanette E. Chapman
*Attorney, Agent, or Firm*—William J. Daley, Jr.

[57] ABSTRACT

A foldable and reusable bib including a flat relatively stiff sheet having a long axis and a width. The flat sheet includes a transverse fold line, transverse to the long axis and extending across the width of the sheet, thereby dividing the sheet into upper and lower portions. The upper portion is defined by two side edges and a top edge, where the top edge has an arcuate section disposed about the long axis and forming part of an aperture in the flat sheet. The each upper portion side edges slopes and extends from the transverse fold line to the tope edge. In another embodiment, the upper portion includes a plurality of angled fold lines proximate each side edge to form a backward folding wing section. Preferably, either bib is made from a recyclable material such as a corrugated paper product.

19 Claims, 3 Drawing Sheets

AUTO BIB WITH INTEGRAL TRAY PORTION

FIELD OF INVENTION

This invention relates to a means for protecting clothing from food and drink spills, particularly a foldable and reusable bib that protects the front torso and lap of the human body and more particularly to such a bib that provides protection to an individual seated in a motor vehicle such as an automobile, a truck, or a recreational vehicle.

BACKGROUND OF THE INVENTION

The number of fast food establishments has increased considerably over the last decade. Also the types of food being offered has changed to reflect the growing numbers of consumers and their changing requirements. Today, an individual can go for example to a McDonald's® for breakfast, lunch or dinner and purchase a meal appropriate for the time of day (e.g., eggs for breakfast or a chicken sandwich for lunch). The meal purchased is eaten in the establishment or taken-out for consumption elsewhere such as in the consumer's motor vehicle. However, while the types of take-out food being served has changed the means generally used by an individual, if used at all, to protect themselves from accidental spills of food or drinks while seated in a motor vehicle is still a napkin lying in the lap.

A napkin in the lap does not protect the upper torso of an individual or the clothing on the upper torso from spills of food or drink. Thus, it is possible for food or drink to spill on the consumer's clothing (e.g., tie or shirt) thereby staining the clothing. Also, the napkin has limited effectiveness (e.g., napkin easily saturated) so that staining can still occur.

For professionals such as salesman, the staining of clothing is a problem because they either have to find a way to change there clothes while on the road, not usually an option, or they have to attend a meeting with a client or prospective client looking less than their best, which is not desirable. For the general public, spillage is also a problem because of the appearance of the stains as well as the annoyance involved with attempting to remove the stains as well as the drying of the clothing usually while still on the individual. Further, the problem of accidental spillage of hot liquids on individuals has recently become a concern for take-out food (e.g., donut) establishments.

Eating and drinking while seated in a motor vehicle is especially prevalent today, because of the availability of a drive through pick-up at most fast food establishments. It is also not uncommon to see motor vehicle passengers, typically children, consuming their food or drink while the motor vehicle (e.g., mini-van) is in motion. A moving vehicle increase the chances of an accidental spillage of food or drink. Since this is customarily done when one is on a tight schedule and/or going to a special event, an accidental spill of food or drink can be especially inconvenient and troublesome.

Staining of clothing is costly and time consuming. Typically, the removal of a stain from the clothing of professionals involves dry cleaning. However, if the stain has set in the clothing (e.g., tie) it may not be possible to remove the stain or it cannot be removed without affecting the garment being cleaned (e.g., cannot be cleaned without affecting the coloration of the clothing). Thus, one must spend time and money to replace the stained article of clothing since it can no longer be used.

Today, because of the quantity of materials (e.g., napkins, food wrappings, food packaging, bags, etc.) being used in the operations of fast food establishments and because of the concern with disposal of these materials, there has been a strong movement for these materials to be made from recyclable materials as well as being recyclable themselves. Thus, the recyclability of the materials is a consideration.

U.S. Pat. Nos. 4,660,224 and 5,181,275 describe two products to protect individuals from a spill while seated in a motor vehicle. U.S. Pat. No. 4,660,224 describes a disposable unisex bib/apron constructed from a flexible material such as paper, plastic coated paper, or plastic that is secured about the neck of an individual. The other patent describes an apron placed in the lap of a seated individual and secured in place by means of the seatbelt. This lap mounted apron only protects the legs and lower torso.

Some products used in eating establishments and/or in a house (e.g., products for feeding a baby) are described in U.S. Pat. Nos. 2,265,690, 2,367,690, 4,114,199, and U.S. Pat. Nos. Des. 323,115 and 323,435. In general, the described products include a bib section and a lower trough or tray portion, where the bib section is secured about the neck of the individual. In this way, the bib section is maintained extended across the upper torso of the individual. The described products typically use flexible or thin sheets of material to construct the described product and in the case of U.S. Pat. No. 2,265,690 the apron has an adjustable neck loop made from a different material.

Thin sheet and flexible sheet materials are suited for disposable bib applications (e.g., one use) but not for reuse applications because of the potential for damage (e.g. tearing) when storing the item. Also, because the thin or flexible sheet has little structural rigidity or stiffness, the product must be secured about the neck so the torso and legs of the individual are protected (i.e., so the bib does not collapse on itself). Flexible products are generally used for bibs and aprons because of their ability to easily conform to an individuals's body profile. Stiffer materials such as a corrugated paper products, however, do not easily conform to the body profile. In addition, stiffer materials create the potential for injuries to the neck region (e.g., paper cuts) as well as restricting the motion of the user's neck and head if secured about the individual's neck.

Other products involving protecting the upper or lower torso of an individual (e.g., a baby) are described in U.S. Pat. Nos. 1,108,557, 2,174,694, 2,580,388, 2,738,511, 3,115,639, 4,261,057, 5,285,940, and U.S. Pat. No. Des. 238,531.

Therefore, it is an object of the present invention to provide a foldable bib for use in protecting the upper and lower torso including the legs of an individual, particularly when the individual is seated in a motor vehicle.

It is another object of the present invention to provide a bib that is reusable and easily stored at the place of sale as well as in the motor vehicle.

It is a further object of the present invention to provide a bib that is not cumbersome or unduly restricts the motion of the user.

It is yet a another object of the present invention to provide a bib that can be manufactured relatively inexpensively and preferably manufactured from recyclable materials.

It is yet a further object of the present invention to provide a bib that is easily adaptable for use by adults or children.

SUMMARY OF THE INVENTION

The instant invention feature two embodiments of a foldable and reusable bib, for protecting the upper and lower torso of an individual, that has an integral tray or lower section. The foldable and reusable bib of one embodiment includes a flat relatively stiff sheet having a long axis and a width. The flat sheet includes a transverse fold line, transverse to the long axis and extending across the width of the sheet, thereby dividing the sheet into upper and lower portions. The upper portion is defined by two side edges and a top edge, where the top edge has an arcuate section disposed about the long axis and forming part of an aperture in the flat sheet. Each of the upper portion side edges slopes and extends from the transverse fold line to the top edge.

The lower portion is defined by two side edges and a bottom edge, each lower portion side edge being essentially parallel to the long axis. The lower portion bottom edge is transverse to the long axis and disposed opposite the transverse fold line so a tray portion is established when the flat sheet is folded. The lower portion further includes a cup holding means for holding a drinking cup in a relatively upright position.

The flat sheet is a stiff paper product such as corrugated board or box board and the transverse fold line in the paper product is a scored fold line or a perforated fold line. The corrugated board is a 3 ply corrugated board such as a 3 ply 200 Lb. test white corrugated board and the scored fold line is formed using the die cutting technique.

The flat sheet has a top surface and the top surface includes a coating relatively impervious to spills of drinking liquids and the coating may be adhered to the top surface. The top surface coating is a wax coating or a plastic material coating.

In another embodiment, the foldable, reusable bib includes a flat relatively stiff sheet having a long axis and a width. The flat sheet further includes a top surface and a transverse fold line, transverse to the long axis and extending across the width of the sheet, that divides the sheet into upper and lower portions. The upper portion is defined by two side edges and a top edge, where the top edge has an arcuate section disposed about the long axis and forming part of an aperture in the sheet. Also include in the upper portion is at least one angled fold line proximate each upper portion side edge and being at an angle with respect to each upper portion side edge to form a foldable wing.

In a preferred embodiment thereto, the upper portion further includes two angled fold lines proximate each upper portion side edge and being parallel to each other, to form each of the side edge foldable wings. In other embodiments thereto, the top edge and each upper portion side edge are interconnected by an arcuate edge portion. The flat sheet material is preferably a recyclable material such as a corrugated paper product, corrugated board or box board and the fold lines therein are scored or perforated fold lines. The corrugated board is a 3 ply corrugated board such as a 3 ply 200 Lb. test white corrugated board and the scored fold line is formed using the die cutting technique.

The top surface includes a coating relatively impervious to spills of drinking liquids and the coating may be adhered to the top surface. The top surface coating is a wax coating or coating of a plastic material.

DESCRIPTION OF THE PREFERRED EMBODIMENT

Figure 1:
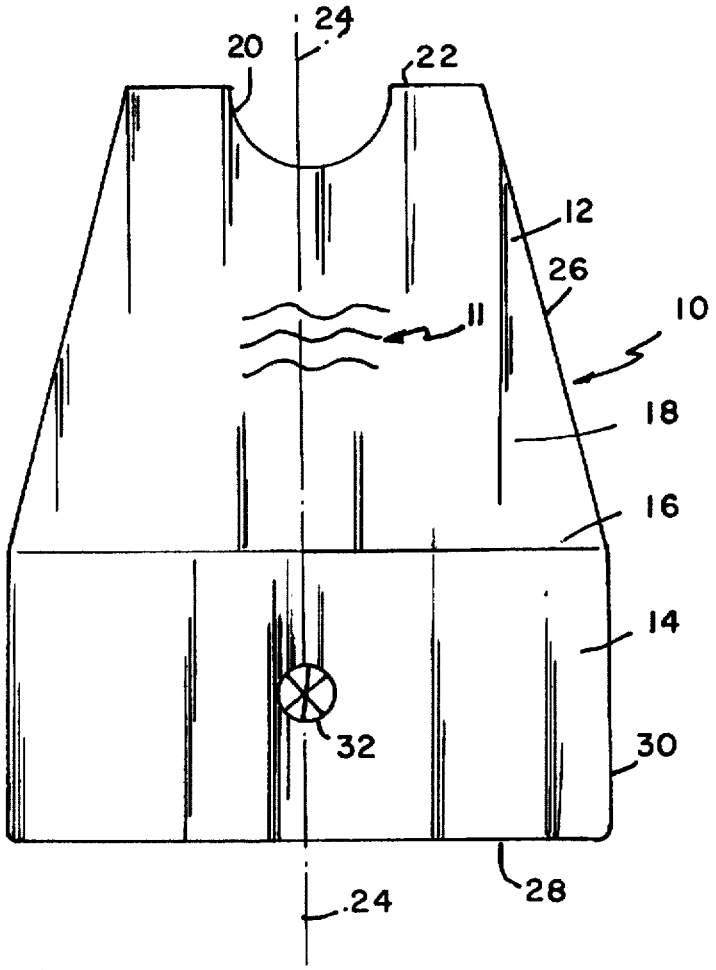
FIG. 1 is a top view of a bib for use in motor vehicles.
Figure 7:
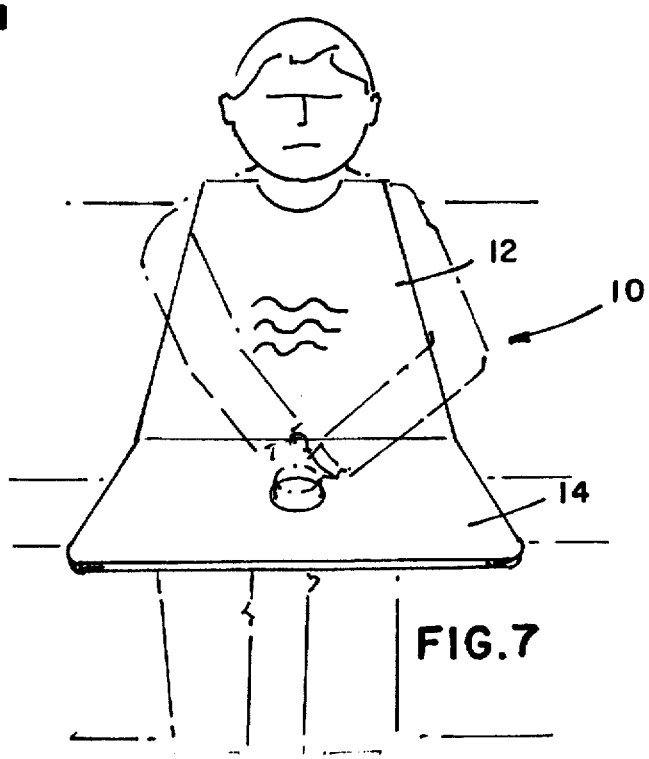
FIG. 7 is an illustration of a bib being used by a person.

There is shown in FIG. 1 one embodiment of a bib 10 according to the present invention for use by individuals seated in motor vehicles (e.g., automobiles, trucks, recreational vehicles). The bib 10 is divided into an upper portion 12 and a lower portion 14 by a fold line 16. The fold line 16 extends across the width of the bib 10 and is transverse to the bib long axis or vertical centerline 24. An illustration of the bib 10 of the instant invention when used by an individual, such as a salesperson, is shown in FIG. 7.

The bib 10 is made from a relatively stiff sheet material that is cut or stamped out into the desired shape of the bib 10.

The sheet material is a corrugated board or box board as well as other laminated paper products known in the art and having the required stiffness.

The paper product being used has sufficient rigidity or stiffness so the upper portion 12 of the bib 10 is self supporting and will not collapse upon itself. That is the bib upper portion 12 does not need to be separately secured to the individual to assure that the upper portion 12 remains extended over and covers the upper torso. Also, the material stiffness is adequate so the lower portion 14 does not deflect appreciably if food is placed on it, when used as a tray, or does not deflect if food or drink spills and collects on the lower portion 14.

A corrugated product useable for making a bib of the instant invention is a 3 ply corrugated board manufactured using techniques known to those in the corrugated box industry. Preferably, the corrugated product is a 3 ply white corrugated board where the white finish is on one surface, the surface visible when the bib is in use or the top surface 18. For example, the bib of the instant invention is made from a 3 ply 200 Lb. test white corrugated board. The thickness and construction of the corrugated board or box board being used is generally acceptable for use (i.e., it has sufficient strength and ridgity) if the material does not deflect significantly from its own weight over the lengths and widths being used for the bib 10.

The paper product sheet material being used is such that the effects of fluid or food spills do not result in saturation of the paper product within a relatively short period of time as is experienced with napkins or other thin sheet paper products. Alternatively, the top surface 18 of the bib 10 includes a coating of a material, such as a wax or plastic coating, to make the bib 10 relatively impervious to a spill. This coating may be applied to the sheet product while each bib 10 is being manufactured or it may be applied to the top surface 18 after the bib 10 is made.

The coating is applied, affixed or bonded to at least the top surface 18 as is known in the art for the coating being used and the material being coated. For example, there a number of techniques known in the corrugated box industry for applying a wax coating during the corrugated board laminating manufacturing process. In addition, the top surface 18 of the bib 10, particularly that part of the top surface 18 in the bib upper portion 12, may include advertising messages/information or, as is done for the foldable auto window shields, may include an emergency message.

Figure 2:
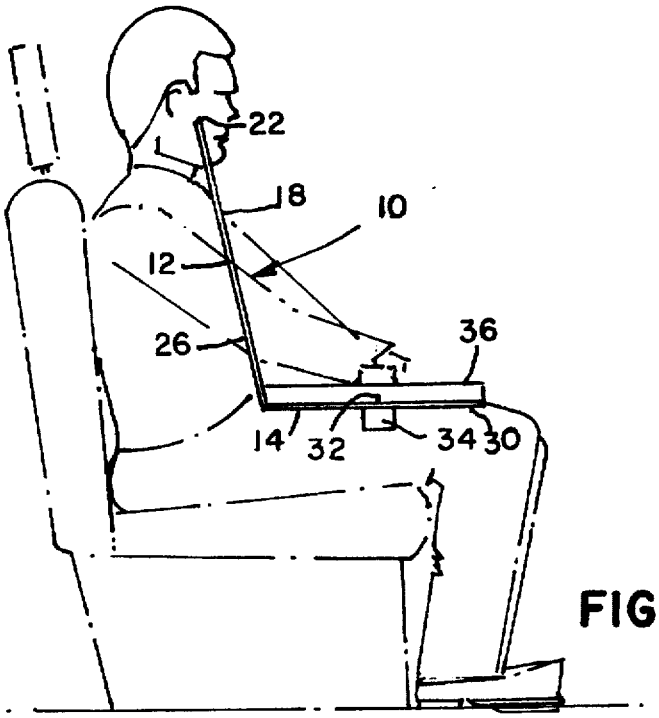
FIG. 2 is a side view of the bib of FIG. 1 when in a folded condition.

The fold line 16 provided in the bib 10 is preferably a scored fold line so the upper and lower portions 12, 14 are pivotable with respect to each other about the fold line 16, as shown in FIG. 2, without breaking through the sheet material being used to make the bib 10. Alternatively, the fold line 16 formed in the paper product is a perforated fold line with provisions made to minimize the leakage effect of the perforations.

The upper portion 12 includes an arcuate section 20 or an arcuate cut out in the top edge 22 of the upper portion 12. The center point of the radius defining the arcuate section 20 is preferably located on the vertical centerline 24 for the bib 10 or centered on the top edge. The radius selected and depth of the cut out in the top edge 22 (i.e, the amount of material being removed) is such that the bib 10 does not cause an appreciable restriction or interference to of movement of the head or neck of an individual when the bib 10 is being used. For example, a cutout of about 5¼ inches across and about ¾ inches deep is sufficient in at least one application.

Preferably, the sides 26 of the upper portion are sloped or angled so the top edge 22 is narrower than the bib's width across the fold line 16. The width of the top edge 22 and the slope or angle of the sides 26 are selected so the upper portion does not appreciable restrict or interfere with the movement of the head or neck as well as the movement of the arms of the individual using the bib 10. For example, the movement of an individual should not be unduly restricted with a width of about 7 inches for the top edge 22 and where the side edges slope outward to a width of about 18 inches, the width across the bib fold line 16. Avoiding a restriction or interference to an individual's motion also assures that the bib 10 is not dislodged (i.e, not knocked off the individual's lap).

Figure 3:
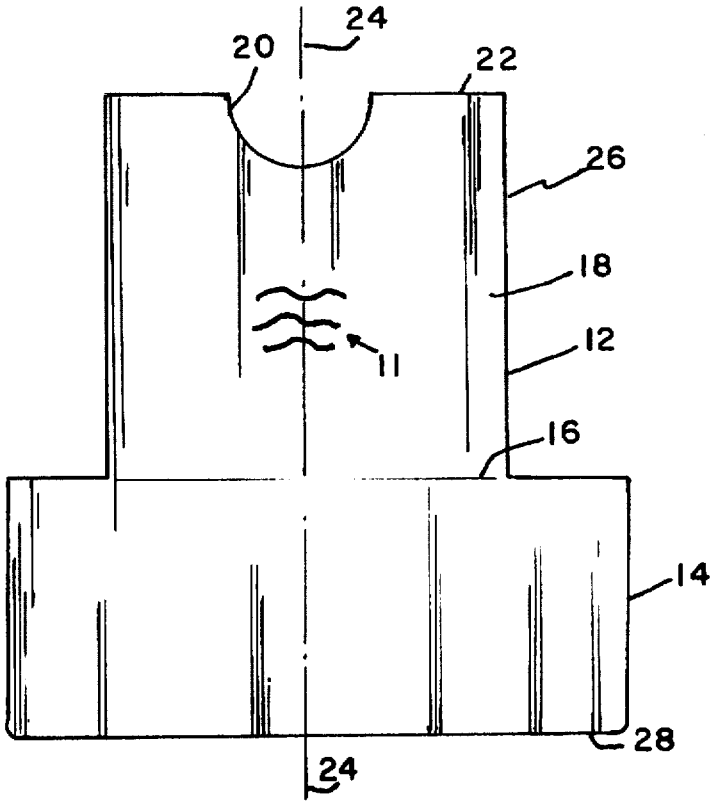
FIG. 3 is a top view of an alternate configuration for the bib of FIG. 1.

While the sides 26 are illustrated as being sloped back from the fold line 16, the sides 26 may be configured to be parallel to the centerline 24 for a short distance and then sloped to meet the ends of the top edge 22. Alternatively, the sides 26 may be configured to be parallel to the centerline 24 for the entire length of the upper portion 12. In this case, the bib's upper portion 12, as well as the fold line 16, does not extend across the entire width of the lower portion 14 but only a portion thereof as shown in FIG. 3. Alternatively, the width across the fold line 16 may be set to equal the width for the top edge 22.

The width of the lower portion 14 and correspondingly the bottom edge 28, is selected so the lower portion 14 extends across the legs and lower torso of the individual. For an adult, a width of about 18 inches is typically sufficient. The length of sides 30 of the lower portion 14 is selected so the lower portion 14 provides a surface to catch food or liquid spills an so the spills do not directly impinge upon the individual's lower torso and legs. A length of about 7 inches is generally adequate for most adults. As shown in FIGS. 1, 3 the intersections or corners of the sides 30 and bottom edge 28 are right angles or rounded, however, the corners are typically rounded since this is the normal practice with products used by individuals.

As shown in FIGS. 1–3, the lower portion 14 is configured with or without a cup holding means 32. The cup holding means 32 is any means known in the art for holding a drinking cup in a relatively upright and secure position so the drinking cup does not fall over when it is not in the hands of the individual. For a paper product this is accomplished in one case by providing a plurality of radial die cut lines in the paper product (i.e., the bib lower portion 14) as illustrated in FIG. 1. When the cup is inserted into the area defined by these die cut lines, the pie shaped sections deform thereby securing the cup in place. As shown in FIG. 2, the cup holding means 32 further includes a barrier 34 so that spills caught on the surface of the lower portion 14 do not leak through the cup holding means 32.

As indicated above, the upper and lower portions 12,14 are pivotable or foldable about the fold line 16, as shown in FIG. 2. When folded in this manner, the lower portion 14 is positioned on the lap of the individual and the upper portion 12 rests against the individual's upper torso. The angle between the upper and lower portions 12, 14 is typically an oblique angle. The length of the upper portion is such that the top edge 22, in particular the arcuate section 22 (FIG. 1) is positioned proximate the individual's neck and beneath the chin. However, there is no need for the bib 10 of the present invention to come into contact with or be in very close proximity to the neck or chin but rather close enough so an accidental spill of food or liquid would be expected to strike at least the upper portion 12.

Figure 6A:
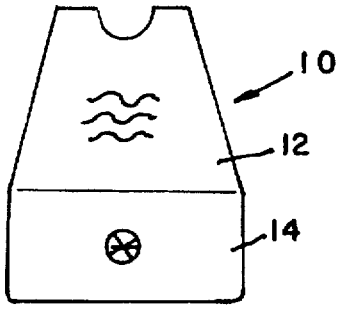
FIGS. 6(*a*), (*b*) are a top and an axonometric view respectively of two storage configurations.
Figure 6B:
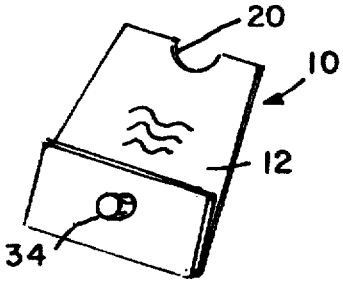

For storage, the bib 10 is returned to its flat unfolded condition as shown in FIGS. 1, 6(*a*). Alternatively for storage of the bib 10, the bib lower portion 14 is folded back onto the upper portion 12, as shown in FIG. 6(*b*).

As shown in FIG. 2, the lower portion 14 alternatively includes a lip portion 36 that extends at least along the length of both lower portion sides 30 and more particularly along both lower portion sides 30 and the lower portion bottom edge 28. The lip portions 36 are constructed using any of a number of techniques known in the art for making a lip in the material used for the bib 10. For example, for a paper product based bib 10, a lip portion may be constructed using tabs, slots and fold lines so the material comprising the lip is folded about one of these additional fold lines and secured to form the lip by inserting a tab into a corresponding slot.

Figure 4:
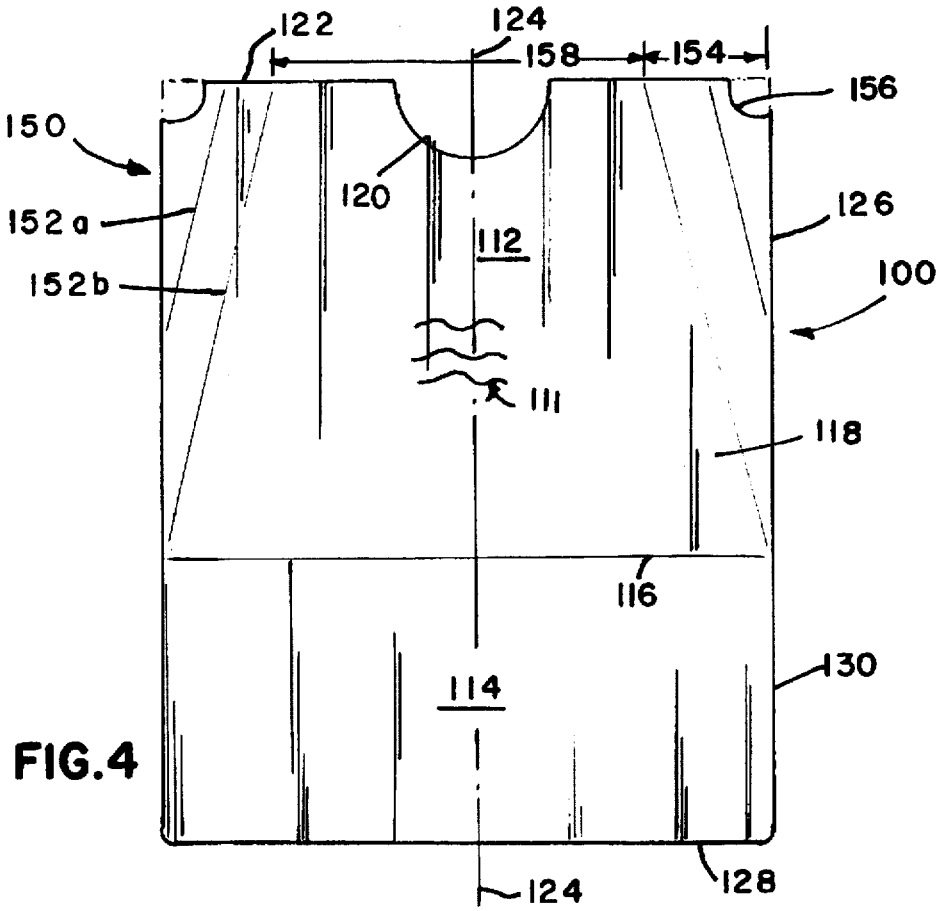
FIG. 4 is a top view of another embodiment of a bib for use in motor vehicles.
Figure 5:
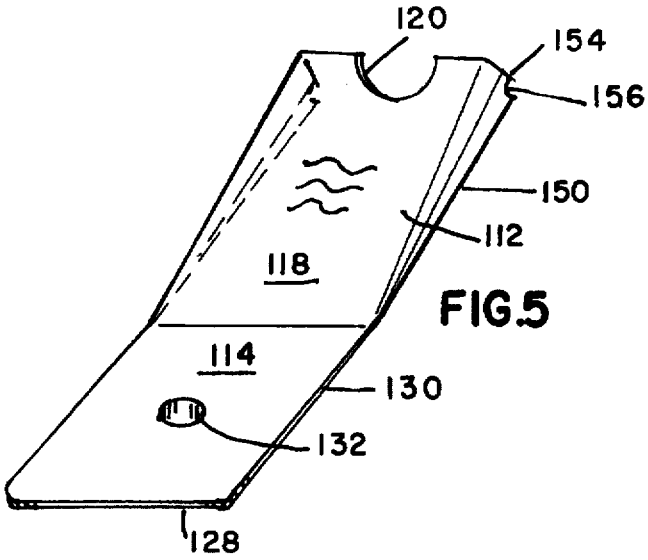
FIG. 5 is an axonometric view of the bib of FIG. 3 when in a folded condition.

Another embodiment of a bib 100 of the instant invention is shown in FIGS. 4–5. The bib 100, as with FIG. 1, is divided into an upper portion 112 and a lower portion 114 by a transverse fold line 116, which extends across the width of the bib 100 and is transverse to the bib long axis or vertical centerline 124.

As discussed above concerning FIG. 1, the bib 100 is made from a relatively stiff sheet material, preferably, a corrugated paper product, a corrugated board or a box board and the top surface 118 of the bib 100 includes a material coating, such as a wax or plastic material coating, to make the bib 100 relatively impervious to a food and/or liquid spill. Also, advertising messages/information and/or emergency messages may be applied to the bib 100 and in particular the bib top surface 118.

The discussion above concerning FIG. 1 should also be referenced for further details about the lower portion 114 including the lower portion sides 130 and bottom edge 128. The lower portion 114 of this embodiment may be configured, as discussed hereinabove, to include a lip portion 36 as well as a cup holding means 32 and its associated barrier 34. As also discussed above, the corner of the lower portion 114 (i.e., the intersection between the bottom edge 128 and each lower portion side edge 130) are at right angles or rounded, however, the corners are preferably rounded.

The transverse fold line 116, as discussed above concerning FIG. 1, is preferably a scored fold line or alternatively is a perforated fold line. The upper portion 112 further includes at least one and preferably two angled fold lines 152*a*,*b*, proximate each of the upper portion side edges 126. The angled fold lines 152*a,b* are provided to form two wing sections 150 that, when they are folded) project backwards at an angle with respect to the top surface 118 (i.e., wing sections 150 project backwards towards the torso and not outward from the top surface 118) as shown in FIG. 5. The flexibility or conformablity of the wing sections to the sides of an individual is increased by adding or increasing the number of fold lines. The wing sections 150 also provide another measure for securing the bib 100 so it does not move around when in use.

The angled fold lines 152 *a,b*, are essentially parallel to each other and are separated a distance sufficient to permit each wing section 150 to conform approximately to the contour of the individual using the bib 100. Typically, the angled fold lines 152*a,b*, are separated by about 1–2 inches. The innermost angled fold line 152*b* extends from the intersection of the transverse fold line 116 with the side edges 126,130 to the top edge 122. The outermost fold line 152*a* extends from a point on the upper portion side edge 126, based on the separation between the angled fold line 152*a,b*, to the top edge 122.

Preferably, the corner formed by the intersection of each upper portion side edge 126 and the top edge 122, is cut out along an arcuate line to provide an arm cut out 156. The arm cut out 156 is provided so a right angle corner is not positioned in proximity to or touching sensitive parts of the body and/or the underside of the arms as well as to minimize restriction on an individual's movement. For example, the arcuate line begins at a point on the top edge 122 about 3 inches in from the point of intersection and ends at a point on the upper side edge 126 about 4 inches down from the point of intersection. When folded, that part 154 of the top edge 122, which lies between the edge of the arm cut out 156 and the intersection of the innermost angled fold line 152*b* and the top edge 122, becomes part of the wing section 150.

When the angled fold lines 152*a,b* are folded, the remaining portion 158 of the top edge 122, which includes the arcuate section cut out 120, is narrower than the width of the lower portion 114. In this way, the remaining portion 158 of the top edge 122 including the arcuate section cut out 120 along with folding the backward folded wing sections 150 does not cause an appreciable restriction or interference to the movement of the head, neck or arms of an individual. Reference should be made to the discussion regarding FIG. 1 for further details regarding the arcuate section 120.

For storage, the bib is returned to its flat condition, unfolded condition as shown in FIGS. 2, 6(*a*). Alternatively, as illustrated in FIG. 6(*b*), the bib lower portion 114 is folded back onto the flattened upper portion 112 (see FIG. 2) for storage of the bib 100.

The bib 10, as shown in FIGS. 1,3,4, is manufactured from a paper product such as a corrugated product (e.g., corrugated board) using a die cut technique or any other equivalent technique known in the art. For the die cut technique, the die being made is configured to produce the product to be manufactured using any of a number of techniques known to those in the corrugated/paper box industry. The configured die is pressed onto a flat sheet of the corrugated product (e.g., a 3 ply 200# test white corrugated board) yielding a bib 10,100 having the desired configuration and attributes. The pressing process is repeated until the required number of bibs are produced. Typically, a continuous length of the corrugated product is introduced into the pressing section to repetitively form the desired product.

In the case of the bib 10, 100 of the instant invention, the die is configured to cut the corrugated paper product to yield a bib 10, 100 having the desired side edges 26,30; 126,130, top edge 22,122 including the arcuate section 20, 120, and bottom edge 28,128 as well as providing the desired type of fold lines 16, 152*a,b* (e.g., scored type of fold line). If the lower portion 14,114 is configured with a cup holding means 32, the die is also configured accordingly. For example, the die may be configured to cut a plurality of radial through die cut lines (i.e., through the thickness of the corrugated paper product) to yield a plurality of deformable pie sections.

While paper products, such as corrugated board and box board, are preferred because they are recyclable and relatively inexpensive compared to other sheet materials, this is not a limitation. The materials used to make the bib 10,100 may be any sheet material known in the art, including plastics, that has equivalent rigidity and stiffness to the above described paper products as well as having at least an equivalent resistance to liquid and food spills. In addition, the manner of making the fold lines 16, 152*a,b*, shall be that known in the art for the sheet material being used. The technique used is preferably that which minimizes the potential for leakage through or about the fold line.

While a preferred embodiment of the invention has been described using specific terms, such description is for illustrative purposes only, and it is to be understood that changes and variations may be made without departing from the spirit or scope of the following claims.

What is claimed is:

1. A foldable bib comprising:

a flat relatively stiff sheet having a long axis and a width;

said flat sheet including a transverse fold line disposed transverse to the long axis and extending across the width of the sheet so as to divide said flat sheet into upper and lower portions;

wherein said upper portion is defined by two side edges and a top edge, said upper portion top edge having an arcuate section disposed about the long axis and forming part of an aperture in said flat sheet; and wherein said flat sheet further includes, in said upper portion, at least two angled fold lines proximate each upper portion side edge and being parallel to each other to from a foldable wing, where each fold line is at an angle with respect to each upper portion side edge.

2. The foldable bib of claim 1, wherein each said upper portion side edge is a sloping side edge that is at an angle with respect to the long axis and extends from said transverse fold line to the upper portion top edge.

3. The foldable bib of claim 1, wherein said lower portion is defined by two side edges and a bottom edge, each lower portion side edge being essentially parallel to the long axis, and said lower portion bottom edge being transverse to the long axis and being disposed opposite said transverse fold line so a tray portion is established when said flat sheet is folded.

4. The foldable bib of claim 3, wherein said lower portion further includes cup holding means for holding a drinking cup in a relatively upright position.

5. The foldable bib of claim 1, wherein said flat sheet is a stiff paper product.

6. The foldable bib of claim 5, wherein said transverse fold line is a scored fold line.

7. The foldable bib of claim 5, wherein said transverse fold line is a perforated fold line.

8. The foldable bib of claim 5, wherein said flat sheet has a top surface and said top surface has a coating relatively impervious to spills of drinking liquids.

9. The foldable bib of claim 8, wherein said top surface coating is a coating of plastic material.

10. The foldable bib of claim 8, wherein said top surface coating is adhered to said flat sheet top surface.

11. The foldable bib of claim 5, wherein said stiff paper product is a corrugated paper product.

12. The foldable bib of claim 11, wherein at least one of said angled fold lines extends from said transverse fold line to the upper portion top edge.

13. A method for making a foldable bib from a flat sheet of a relatively stiff paper product comprising the steps of:

configuring a stamping die to produce a foldable bib having a long axis, a width, a transverse fold line disposed transverse to the long axis and extending across the width so as to divide the foldable bib into upper and lower portions, where the upper portion has two side edges and a top edge, the upper portion top edge having an arcuate section disposed about the long axis and forming part of an aperture in the flat sheet;

wherein said step of configuring includes configuring the die so two angled fold lines are provided in the upper portion proximate each upper portion side edge, where the angled fold lines proximate each upper portion side edge are parallel to each other and are at an angle with respect to each upper portion side edge; and pressing the die onto the flat sheet of the relatively stiff paper product, thereby forming the foldable bib defined by the configuration of the die.

14. The method of claim 13, wherein the flat sheet has a top surface and wherein the method further comprises the step of coating the top surface with a material relatively impervious to spills of drinking liquids.

15. The method of claim 13, wherein said step of configuring includes configuring the die to produce a foldable bib with a means for holding a drinking cup.

16. The method of claim 13, wherein said step of configuring includes configuring the die so the transverse fold line is a scored fold line.

17. The method of claim 13, wherein said step of configuring includes configuring the die so each of the transverse and upper portion angled fold lines is a scored fold line.

18. The method of claim 1, wherein said step of configuring includes configuring the die so the lower portion is defined by two side edges and a bottom edge, each lower portion side edge being essentially parallel to the long axis, and the lower portion bottom edge being transverse to the long axis and being disposed opposite the transverse fold line so a tray portion is established when the flat sheet is folded.

19. The method of claim 13, wherein said step of configuring includes configuring the die so at least one angled fold line extends between the upper portion top edge and the transverse fold line.

* * * * *